United States Patent [19]

Poppendiek

[11] 4,343,181

[45] Aug. 10, 1982

[54] METHOD FOR DETERMINING THERMAL CONDUCTIVITY AND THERMAL CAPACITY PER UNIT VOLUME OF EARTH IN SITU

[75] Inventor: Heinz F. Poppendiek, LaJolla, Calif.

[73] Assignee: The United Stated of America as represented by the United States Department of Energy, Washington, D.C.

[21] Appl. No.: 129,300

[22] Filed: Mar. 11, 1980

[51] Int. Cl.[3] ..... E21B 49/00

[52] U.S. Cl. ..... 73/154

[58] Field of Search ..... 73/154, 15 A, 190 H

[56] References Cited

U.S. PATENT DOCUMENTS

| | | | |
|---|---|---|---|
| 2,274,248 | 2/1942 | Scherbatskoy et al. | 73/154 |
| 2,311,757 | 2/1943 | Jakosky | 73/154 |
| 3,668,927 | 6/1972 | Howell et al. | 73/154 |
| 3,714,832 | 2/1973 | Howell et al. | 73/154 X |
| 3,807,227 | 4/1974 | Smith, Jr. | 73/154 |
| 3,808,889 | 5/1974 | Rawson et al. | 73/154 |
| 3,864,969 | 2/1975 | Smith, Jr. | 73/154 |
| 3,981,187 | 9/1976 | Howell | 73/154 |

FOREIGN PATENT DOCUMENTS

| | | | |
|---|---|---|---|
| 135746 | 5/1979 | Fed. Rep. of Germany | 73/154 |

OTHER PUBLICATIONS

D. A. Christoffel et al.—Journal Of Scientific Instruments, 1969, Series 2, vol. 2, pp. 457-465.

*Primary Examiner*—Charles A. Ruehl

*Attorney, Agent, or Firm*—Clifton E. Clouse; Roger S. Gaither; Richard G. Besha

[57] ABSTRACT

A method for determining the thermal conductivity of the earth in situ is based upon a cylindrical probe (10) having a thermopile (16) for measuring the temperature gradient between sets of thermocouple junctions (18 and 20) of the probe after it has been positioned in a borehole and has reached thermal equilibrium with its surroundings, and having means (14) for heating one set of thermocouple junctions (20) of the probe at a constant rate while the temperature gradient of the probe is recorded as a rise in temperature over several hours (more than about 3 hours). A fluid annulus thermally couples the probe to the surrounding earth. The recorded temperature curves are related to the earth's thermal conductivity, $k_\infty$, and to the thermal capacity per unit volume, $(\gamma c_p)_\infty$, by comparison with calculated curves using estimates of $k_\infty$ and $(\gamma c_p)_\infty$ in an equation which relates these parameters to a rise in the earth's temperature for a known and constant heating rate.

6 Claims, 9 Drawing Figures

METHOD FOR DETERMINING THERMAL CONDUCTIVITY AND THERMAL CAPACITY PER UNIT VOLUME OF EARTH IN SITU

The U.S. Government has rights in this invention pursuant to Contract No. E(04-3)-1318 between the U.S. Department of Energy and Geoscience Limited.

BACKGROUND OF THE INVENTION

The invention relates to a method and apparatus for determining in situ the earth's thermal conductivity and thermal capacity per unit volume.

The thermal properties of earth are of considerable importance to the geologist, construction engineer, and others engaged in the study and application of the earth sciences. Thermal conductivity and diffusivity of the earth are the principal determinants of the temperature profile of the earth's surface, the depth of frost penetration, the freezing and thawing characteristics of land areas, and similar factors which critically influence the design of buildings, airports, and roads, especially in arctic environments. The thermal properties of building construction and insulation materials must also be considered and evaluated to establish the overall heat flow pattern into the surrounding earth.

Thermal property measurements are often required in field locations as well as in the laboratory. Laboratory studies can be conducted under closely controlled conditions where equipment and personnel are not limited by the available power, space and an adverse environment. In situ measurements, however, must be conducted with few operating personnel and with limited portable equipment capable of operation in adverse environments.

The practice has been to measure the earth thermal conductivity in a borehole by means of a probe which consists of a body containing at least one temperature sensor and a heater. The sensor is thermally insulated from a heater and is adpated to be maintained in thermal contact with the wall of the borehole, cased or uncased, while in use. The sensed temperature of the surrounding earth will increase proportionally to the heat flux applied, and inversely proportional to the thermal conductivity of the earth. Consequently, by making temperature measurements at predetermined time intervals, a heating curve is obtained that may be related to thermal conductivity. Representative of this technique is a system described in U.S. Pat. No. 3,668,927.

An alternative technique described in U.S. Pat. No. 3,864,969 is to heat the earth for a predetermined period to elevate its temperature, and then log the rate of temperature decay. Still another technique described in U.S. Pat. No. 3,981,187 is to lower a heated probe in a borehole at a constant rate. A sensor at the leading end of the probe measures earth temperature before being heated, and a sensor at the trailing end of the probe measures earth temperature after heating. Thermal conductivity of the earth at any point is inversely proportional to the temperature change as the probe passes the point if the heat flux rate is maintained constant.

In all these prior art systems, the probe includes some means for maintaining physical contact of the probe with the wall of the borehole in order for the temperature sensors to be thermally coupled to the surrounding earth. Because the wall of the borehole is not necessarily smooth and straight, it is difficult to provide for the desired physical contact without some risk of the probe becoming stuck at some level as it is lowered, or jamming in the borehole as it is raised. There is therefore a need for a new probe and method of measuring thermal conductivity which does not require contact with the borehole wall.

OBJECTS AND SUMMARY OF THE INVENTION

An object of this invention is to provide a method of determining thermal conductivity of earth using a probe in a borehole.

Another object is to provide a method of determining thermal capacity per unit volume of earth using a probe in a borehole.

A further object of the invention is to provide an improved geothermal exploration probe which does not require physical contact with the borehole wall.

These and other objects of the invention are achieved with a probe comprising a long cylinder containing a heater, and a temperature sensor in one zone, and containing a second temperature sensor in another zone displaced from the first zone. The probe is positioned in the borehole at the level of interest, and maintained in position for a period sufficient for the probe to be in thermal equilibrium with the surrounding earth to establish a thermal gradient at equilibrium in the earth between the two zones of the probe. The probe is spaced from the borehole wall by a thin fluid annulus so that physical contact with the wall does not exist. The heater is then turned on to apply heat at a known constant rate, $(q/A)_o$, and the thermal gradient between the sensors is recorded as a curve during this heating period. The thermal conductivity, $k_\infty$, and the thermal capacity per unit volume, $(\gamma c_p)_\infty$, of the surrounding earth is determined by relating the recorded temperature curve to a curve of known $k_\infty$ and $(\gamma c_p)_\infty$ for the same rate of heating. In other words, the experimental temperature gradient curve for a constant rate of heating is compared with a theoretical temperature gradient curve (for the same constant rate of heating) calculated from values of thermal conductivity, $k_\infty$, and thermal capacity per unit volume, $(\gamma c_p)_\infty$, estimated to best fit the calculated curve to the experimental curve in a manner to be described more fully hereinafter. The process may be repeated in adjacent boreholes to map the thermal conductivity of the earth over a wide area of a geothermal field.

The novel features that are considered characteristic of this invention are set forth with particularity in the appended claims. The invention will best be understood from the following description when read in connection with the accompanying drawings.

Reference will now be made in detail to preferred embodiments of the invention, an example of which is illustrated in the accompanying drawings.

DESCRIPTION OF PREFERRED EMBODIMENTS

Figure 1:
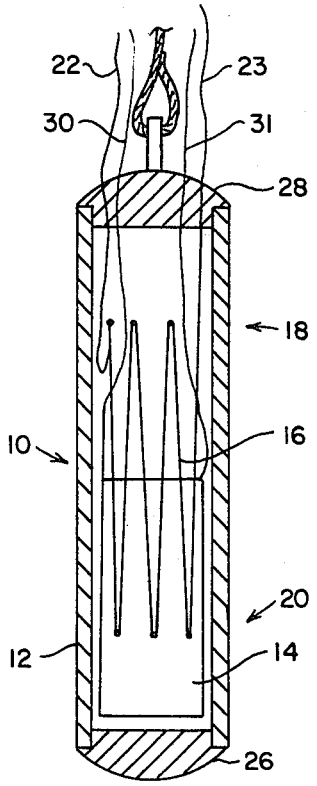
FIG. 1 illustrates schematically an elongated tube transducer of the present invention.

To satisfy a need to measure the earth's thermal conductivity, $k_\infty$, and earth's thermal capacity per unit volume, $(\gamma c_p)_\infty$, in a borehole by means of a probe that does not have to be pressed against the earth bounding the hole, or be positioned in a smaller hole, a transducer is provided as illustrated schematically in FIG. 1. In accordance with the invention, a probe 10 is comprised of a long (6 to 9 feet) cylindrical tube 12, (e.g., a stainless steel tube) which forms a thin outer shell containing a surface heater 14 around the inside of the lower half and a thermopile 16 having a first set of thermocouples (cold junctions) 18 and a second set of thermocouples (hot junctions) 20 connected in series to produce a voltage signal proportional to the temperature gradient between the ends of the transducer without amplification. Leads 22 and 23 from the thermopile are connected to a recording potentiometer 24.

Figure 2:
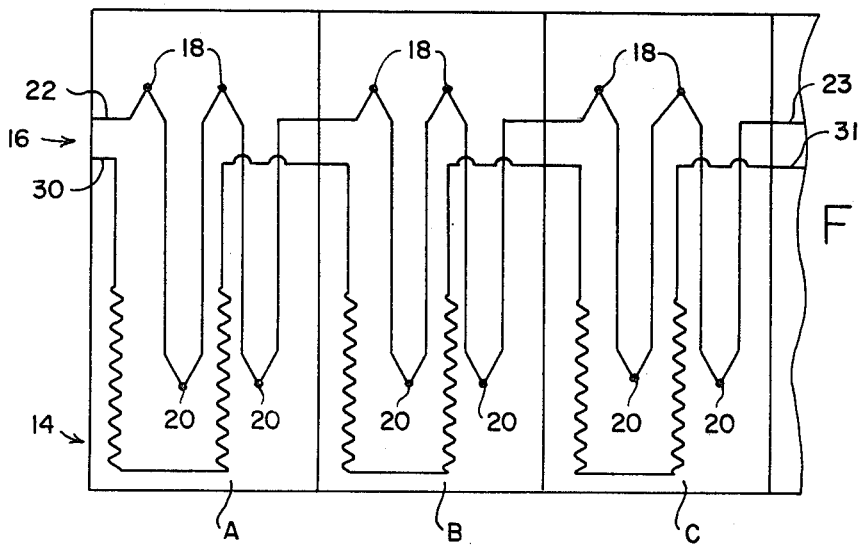
FIG. 2 illustrates the manner which an array of thermopile and heater sections may be assembled for insertion in the tube of the transducer of FIG. 1.

FIG. 2 illustrates schematically an arrangement for the thermopile 16. The arrangement consists of thin, long heater/thermopile assemblies, A, B, C, . . . that could be placed side by side and wired together to form a complete assembly which, when formed into a cylinder, would have a diameter that corresponds to the inner diameter of the tube 12 to place the heater and thermopile against the inner wall of the tube. The tube is made of thermal conductive material, such as stainless steel, which is also an electrical conductor, so both the heater and thermopile must be electrically insulated from the tube, and from each other. This must be accomplished by a laminate construction of thin teflon with a sheet of Teflon on the outside, a sheet of Teflon on the inside, and a sheet of Teflon between the thermopile and the heater.

In practice, each assembly may be only inches wide and four to six feet long. When assembled, the sections are placed edge to edge and electrically and mechanically connected before sealing, to form an assembly that would in width approximate the inside circumference (surface area) of the tube 11. The completed assembly could be inserted through one end of the tube, one end of which has already been closed by an end plate 26 and sealed with an O-ring or welded seam, and the open end then similarly sealed with a plate 28 having a lowering cable connected to it and connectors for the leads 22 and 23 of the thermopile, and leads 30 and 31 for the heater.

Figure 3:
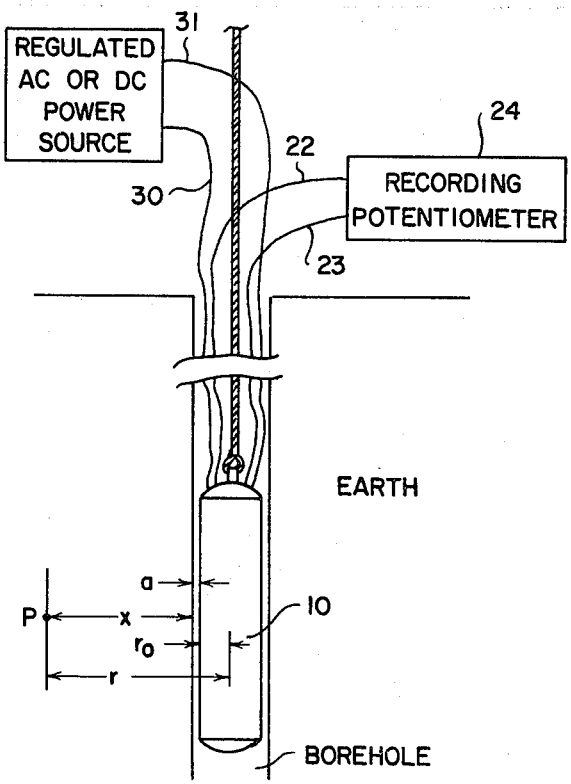
FIG. 3 illustrates the transducer of FIG. 1 lowered into a borehole in the earth.

In accordance with the invention, the thermal conductivity probe 10 is lowered into position in a borehole, as shown in FIG. 3, leaving a fluid annulus. In practice, the diameter of the tube is selected to be as close to the diameter of the borehole as possible without creating a risk of the tube 12 jamming in the borehole. The fluid may be air (if kept very thin), but it would be preferable to have water or mud for the fluid. In either case, direct thermal contact between the tube and the borehole wall is not required.

The fluid annulus is an important feature of the invention because the probe can be used to measure the earth's conductivity without the necessity of requiring that the probe press against, or otherwise be in physical contact with, the wall of the borehole. In accordance with the invention, the effect of the fluid annulus on the transient temperature record can be readily taken into account during such measurement. The addition of a fluid annulus between the probe and the borehole wall changes the transient conduction system into a two region problem. One region is a thin annulus and the other is a semi-infinite solid (the earth). Consider first the case of a thin slab located adjacent to a semi-infinite slab, where the thin slab represents the fluid annulus and the semi-infinite slab represents the surrounding earth along some radius from the center of the cylindrical probe as shown in FIG. 3. The transient boundary value problem for this system is:

For $0 < x < a$:

$$\frac{\partial t}{\partial \theta} = D_1 \frac{\partial^2 t}{\partial x^2} \quad (1)$$

$$t(x,0) = 0 \quad (2)$$

$$\left(\frac{q}{A}\right)_o = -k_1 \frac{\partial t}{\partial x}(0,\theta) \quad (3)$$

For $x > a$:

$$\frac{\partial t}{\partial \theta} = D_2 \frac{\partial^2 t}{\partial x^2} \quad (4)$$

$$t(x,0) = 0 \quad (5)$$

$$\lim_{x \to \infty} t(x,\theta) = 0 \quad (6)$$

where:

t, temperature, $\theta$, time, x, distance into the semi-infinite solid measured from the outer surface of the thin slab, $D_1$, thermal diffusivity of the thin slab, $D_2$, thermal diffusivity of the semi-infinite slab, $(q/A)_o$, constant heat flux addition at $x=0$, $k_1$, thermal conductivity of the thin slab, and a, thickness of the thin slab The interface conditions for this boundary value problem are:

$$t(a-0,\theta) = t(a+0,\theta) \quad (7)$$

$$k_1 \frac{\partial t}{\partial x}(a-0,\theta) = k_2 \frac{\partial t}{\partial x}(a+0,\theta) \quad (8)$$

where, $k_2$, is the thermal conductivity of the semi-infinite solid. The temperature solution of this boundary value problem can be found in a paper by the inventor titled, "Two-Dimensional Transport Models for the Lower Layers of the Atmosphere," International Journal of Heat and Mass Transfer, Vol. II No. 1, pp. 67–79, 1968, which paper is incorporated herein by reference and made a part hereof. For the thin slab (annulus) region, $$t = \frac{\left(\frac{q}{A}\right)_o \sqrt{D_1 D_2}}{\sqrt{D_1}\ k_2 + \sqrt{D_2}\ k_1} \sum_o^n \lambda^n \left[ 2\sqrt{\frac{\theta}{\pi}}\, e^{-\frac{(2an+x)^2}{4D_1\theta}} - \frac{(2an+x)}{\sqrt{D_1}}\, erfc\left(\frac{2an+x}{2\sqrt{D_1\theta}}\right) + 2\sqrt{\frac{\theta}{\pi}}\, e^{-\frac{(2an+2a-x)^2}{4D_1\theta}} - \frac{(2an+2a-x)}{\sqrt{D_1}}\, erfc\left(\frac{2an+2a-x}{2\sqrt{D_1\theta}}\right)\right] + \tag{9}$$

$$= \frac{\left(\frac{q}{A}\right)_o k_2}{\sqrt{D_1}\ k_2 + \sqrt{D_2}\ k_1} \left(\frac{D_1}{k_1}\right) \sum_o^n \lambda^n \left[ 2\sqrt{\frac{\theta}{\pi}}\, e^{-\frac{(2an+x)^2}{4D_1\theta}} - \frac{(2an+x)}{\sqrt{D_1}}\, erfc\left(\frac{2an+x}{2\sqrt{D_1\theta}}\right) - 2\sqrt{\frac{\theta}{\pi}}\, e^{-\frac{(2an+2a-x)^2}{4D_1\theta}} + \frac{(2an+2a-x)}{\sqrt{D_1}}\, erfc\left(\frac{2an+2a-x}{2\sqrt{D_1\theta}}\right)\right]$$

$$\text{where } \lambda = \frac{\sqrt{D_2}\ k_1 + \sqrt{D_1}\ k_2}{\sqrt{D_2}\ k_1 + \sqrt{D_1}\ k_2} \tag{10}$$

and n=0, 1, 2 . . .

Figure 4:
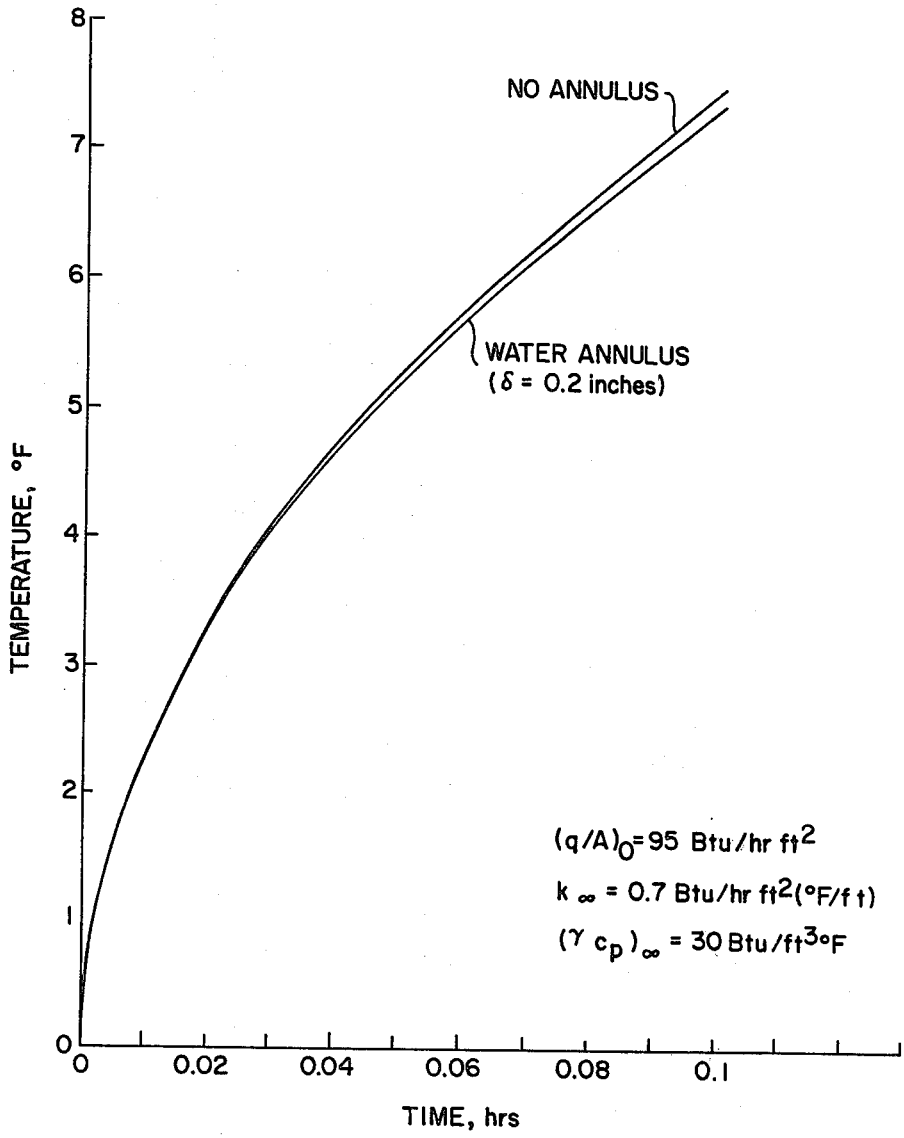
FIG. 4 illustrates a time-temperature history of a thermal conductivity/thermal capacity probe system with and without a water annulus.

Typical calculates were made for a linear, two component slab system which will also hold for a cylindrical coordinate system of a fluid (water) annulus contiguous to the surrounding semi-infinite earth using Equation (9). Typical results are shown in FIG. 4; also shown is a curve for a system where no water annulus exists. The parameters used in the calculations are shown in the legends.

Figure 5:
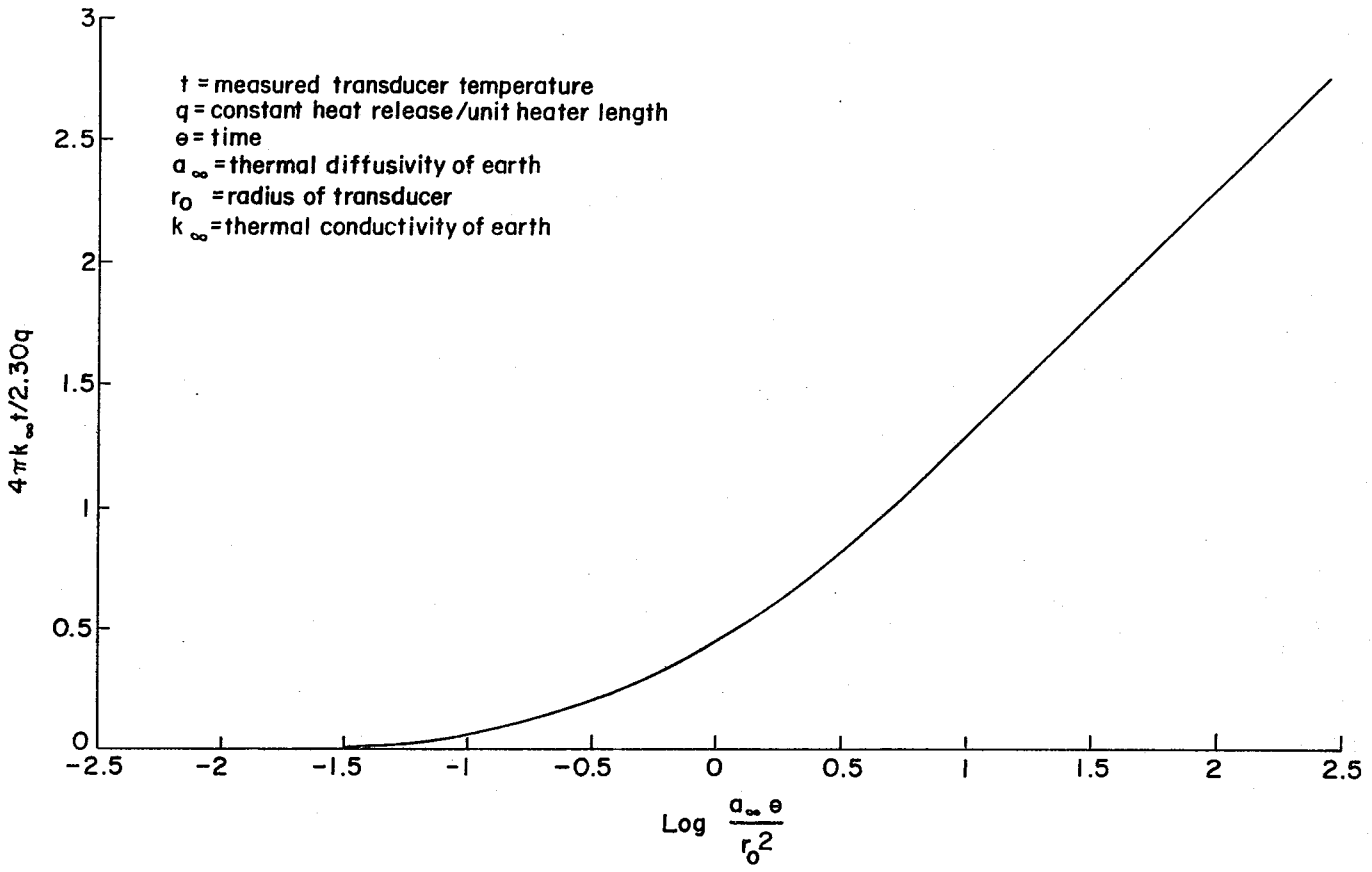
FIG. 5 shows a generalized graph of temperature versus time for a cylindrical step function heat release system.

Thus the annulus solution given by Equation (9) can be used to define the temperature field of the annulus in the cylindrical system; its combination with the corresponding temperature field of the one-component cylindrical system yields the total solution. The "temperature field" is defined as the gradient resulting from a constant rate of heating which is a function of the thermal conductivity, $k_\infty$, and the thermal capacity per unit volume, $(\gamma c_p)_\infty$. The one-component cylinder solution that can be found in heat transfer texts (for example, Newman, A. B., *Industrial and Engineering Chemistry*, Vol. 23, p. 29, 1931) is shown in FIG. 5 in a generalized form. The curve shown in this generalized form was calculated from the following equation:

$$\frac{4\pi k_\infty}{2.30q}\, t = \int_{-\infty}^{\log \frac{k_\infty}{\gamma_\infty c_{p\infty}}\theta} e^{-\frac{(r_o^2+r^2)}{4\frac{k_\infty}{\gamma_\infty c_{p\infty}}\theta}} J_o\left(\frac{ir_o r}{2\frac{k_\infty}{\gamma_\infty c_{p\infty}}\theta}\right) d\left(\log \frac{k_\infty}{\gamma_\infty c_{p\infty}}\theta\right) \tag{11}$$

where:

t, temperature at distance r, $\theta$, time, $k_\infty$, thermal conductivity of the earth, $\gamma_\infty$, density of the earth, $c_{p\infty}$, specific heat of the earth, r, distance from probe centerline (FIG. 3), $r_o$, radius of heating probe (FIG. 3), i, square root of −1, and $J_o$, Bessel function of first order.

This equation may be integrated numerically or graphically. Note that $\gamma_\infty$ and $c_{p\infty}$ together define thermal capacity per unit volume of the earth, $(\gamma c_p)_\infty$, and that thermal diffusion of the earth, $a_\infty$, indicated in FIG. 5, is equal to $k_\infty$ divided by $(\gamma c_p)_\infty$. The temperature differences between systems with and without annuli (Equation 9) can be applied to FIG. 5. In other words the temperature solution for the linear annulus (Equation 9) is added to the temperature solution of the classical radial earth system (Equation 11).

Another feature that is important is the inclusion of cold (reference) thermopile junctions 18 outside the heated zone for the hot (heated) thermopile junctions 20. By measuring the temperature gradient along the length of the tube 12, it is possible to omit having reference junctions outside the borehole and still maintain high measurement accuracy.

When using the probe, it is inserted into a borehole in an area of interest, as shown in FIG. 3, and maintained in position for a period sufficient for it to be in thermal equilibrium with the surrounding earth. The vertical temperature gradient is then measured with no heat being applied (i.e., without energizing the surface heater 14). After that is accomplished, the surface heater is energized, and the transient temperature field is measured (above the temperature datum defined by the unheated junction set) as heat is applied at a constant rate. For short time periods after the beginning of the constant heating process, the thermal capacity per unit volume of the surrounding earth has a more pronounced effect on the time-temperature function than does the thermal conductivity of the earth. At long time periods after heating is initiated, the thermal conductivity is more important.

In practice the time-temperature gradient produced and recorded in situ as an experimental curve during heating can be theoretically determined and recorded as a calculated curve using Equation (9) from best estimates of $k_\infty$ and $(\gamma c_p)_\infty$. But before applying the heat to record the experimental curve, care must be taken to be sure that the probe is in equilibrium. That can be done in different ways, but it is most practical to simply allow sufficient time for the recording potentiometer to reach a constant thermal gradient. The recorder is then adjusted for that constant gradient to be plotted as zero at time zero on the graph. Time zero is the time, $\theta$, at which the heater is turned on to apply heat at a constant rate. The procedure is then to apply a step function through the surface heater and extract from the time-temperature measurements the surrounding earth's thermal conductivity, $k_\infty$, and thermal capacity per unit volume, $(\gamma c_p)_\infty$.

Figure 6:
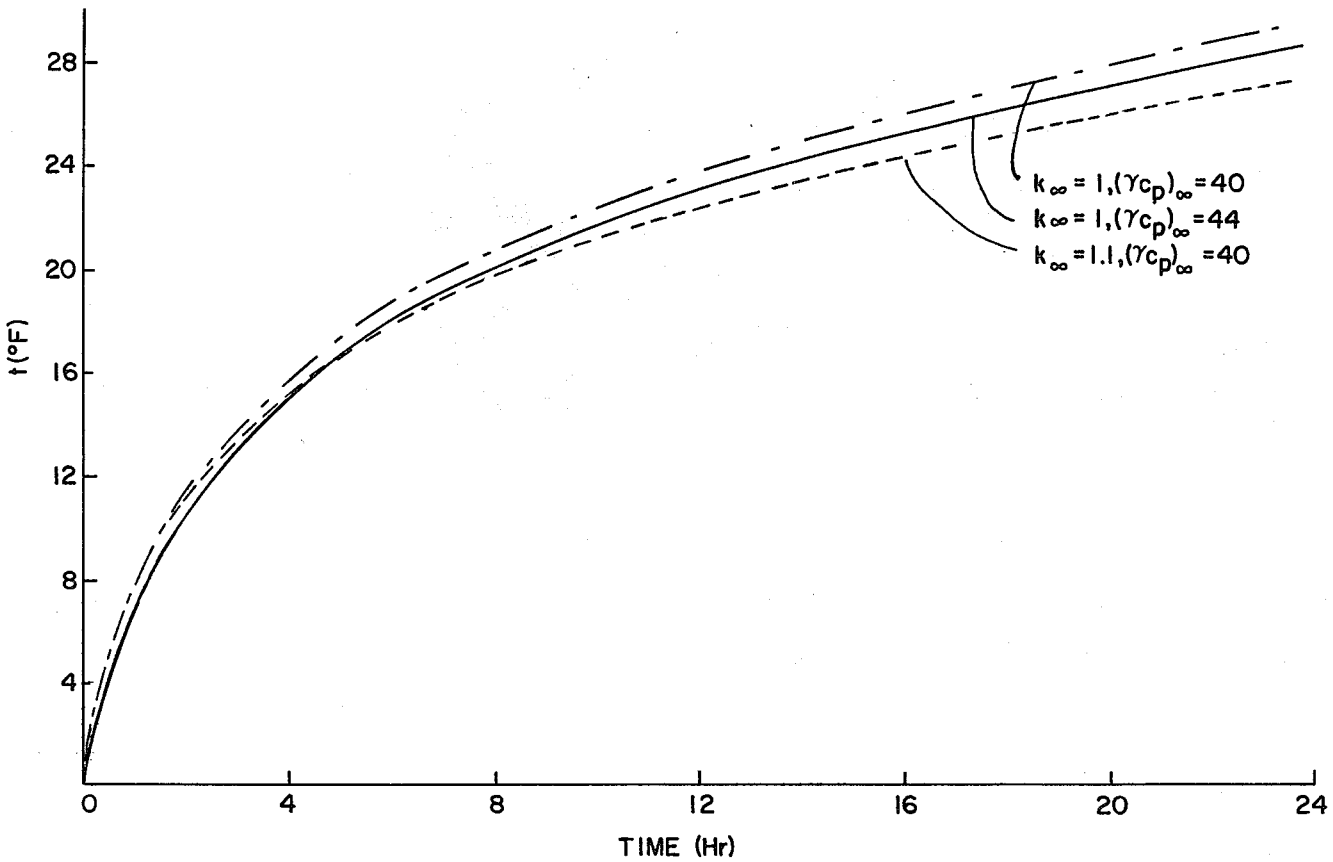
FIG. 6 shows perturbation calculations where the thermal conductivity, $k_\infty$, and thermal capacity per unit volume, $(\gamma c_p)_\infty$, for the earth are varied by 10% about fixed values.

Referring now to FIG. 6, three curves have been plotted using Equation (9). For each curve, the same constant rate of heat is used to calculate the rise in temperature, t(°F.), from the same datum temperature, but with different values of thermal conductivity and thermal capacity per unit volume as indicated in the graph of the curves. The upper curve is for $k_\infty = 1$ Btu/hr ft$^2$°F./ft and $(\gamma c_p)_\infty = 40$ Btu/ft$^3$° F. If the value of thermal capacity per unit volume is increased 10% (center solid curve), the temperature will rise at a lower rate during the first hour and reach a lower temperature after about 16 hours than it would with the value of thermal capacity per unit volume at 40. This is as it should be due to the greater thermal capacity for the same thermal conductivity. Then if the value of thermal capacity is again assumed to be the same as for the first (upper) curve, and instead the value of thermal conductivity is increased 10%, the temperature rise is initially the same over the first one or two hours, but due to the greater thermal conductivity of the earth, the temperature reached after about 16 hours is seen to be lower. This is also as would be expected because the higher thermal conductivity causes more of the heat to be conducted away, and with less heat being stored, the temperature reached at any given time after the initial few hours is less.

Two interesting characteristics should be noted from these curves of FIG. 6. First, increasing thermal capacity will decrease the slope of the curve over the first few hours, but after that the rise in temperature is about the same as before increasing thermal capacity. If additional curves were to be plotted for higher values of thermal capacity per unit volume, each curve would be with progressively lower slope over the first few hours, and only slightly lower value over the longer period of about 16 hours. Second, increasing thermal conductivity instead will not change the slope over the first few hours, but will more significantly lower the temperatures reached over the longer periods. If additional curves were to be plotted for higher thermal conductivity, each curve would be with virtually the same initial slope, but with progressively lower temperatures reached over the longer periods. So, for a chosen value of $k_{28}$, a family of curves could be generated for different values of $(\gamma c_p)_\infty$, and for other chosen values of $k_\infty$, a similar family of curves could be generated. Such curves could then be used to determine the thermal conductivity, $k_\infty$, and the thermal capacity per unit volume, $(\gamma c_p)_\infty$, of earth at a particular location from an experimental curve recorded with the same step function of applied heat. The determination of both thermal parameters of the earth would be uniquely determined by matching the experimental curve with one of the curves in the family of curves. This could be done graphically, once the families of curves have been calculated and plotted, or could be done numerically.

A numerical approach may take the form of a computer programmed to make the comparison of the experimental curve with the calculated curves for the best match, but may also take the following form which can be carried out without first calculating families of curves. This perhaps less complex numerical approach would be carried out, after first recording the experimental curve, by making a best initial estimate of the thermal parameters and calculating a curve to be compared with the experimental curve. If the initial slope of the calculated curve does not match the initial slope of the experimental curve, the parameter $(\gamma c_p)_{28}$ is adjusted until it does. Then the parameter $k_\infty$ is similarly adjusted to bring the calculated curve into coincidence with the experimental curve. It may then be necessary to make a small final adjustment in the parameter $(\gamma c_p)_\infty$, and to follow that with a small final adjustment in the parameter $k_\infty$. The final values of the adjusted parameters thus yield the desired information, namely the thermal conductivity of the earth where the experimental curve was recorded, and also the thermal capacity per unit volume of the earth.

Figure 7:
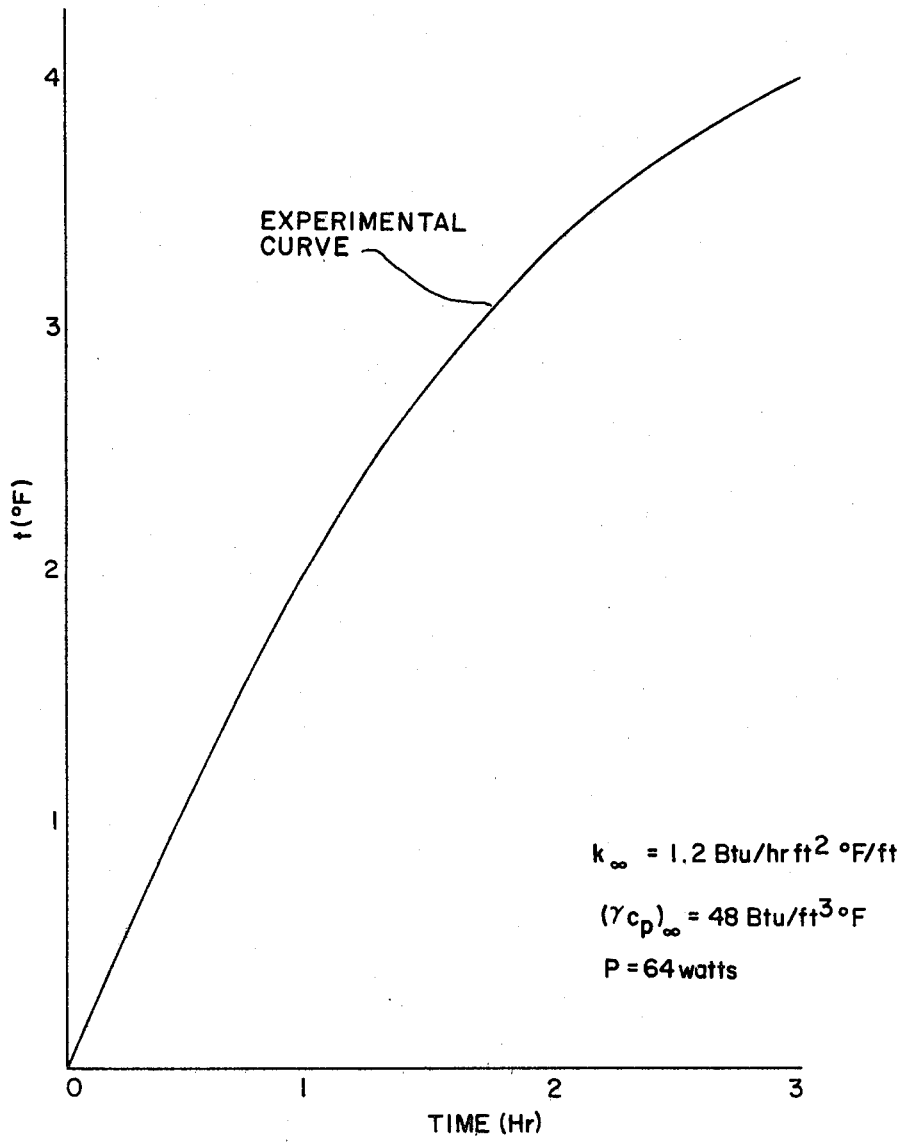
FIG. 7, shows a typical curve of change in thermal gradient recorded with the probe of FIG. 1.
Figure 8:
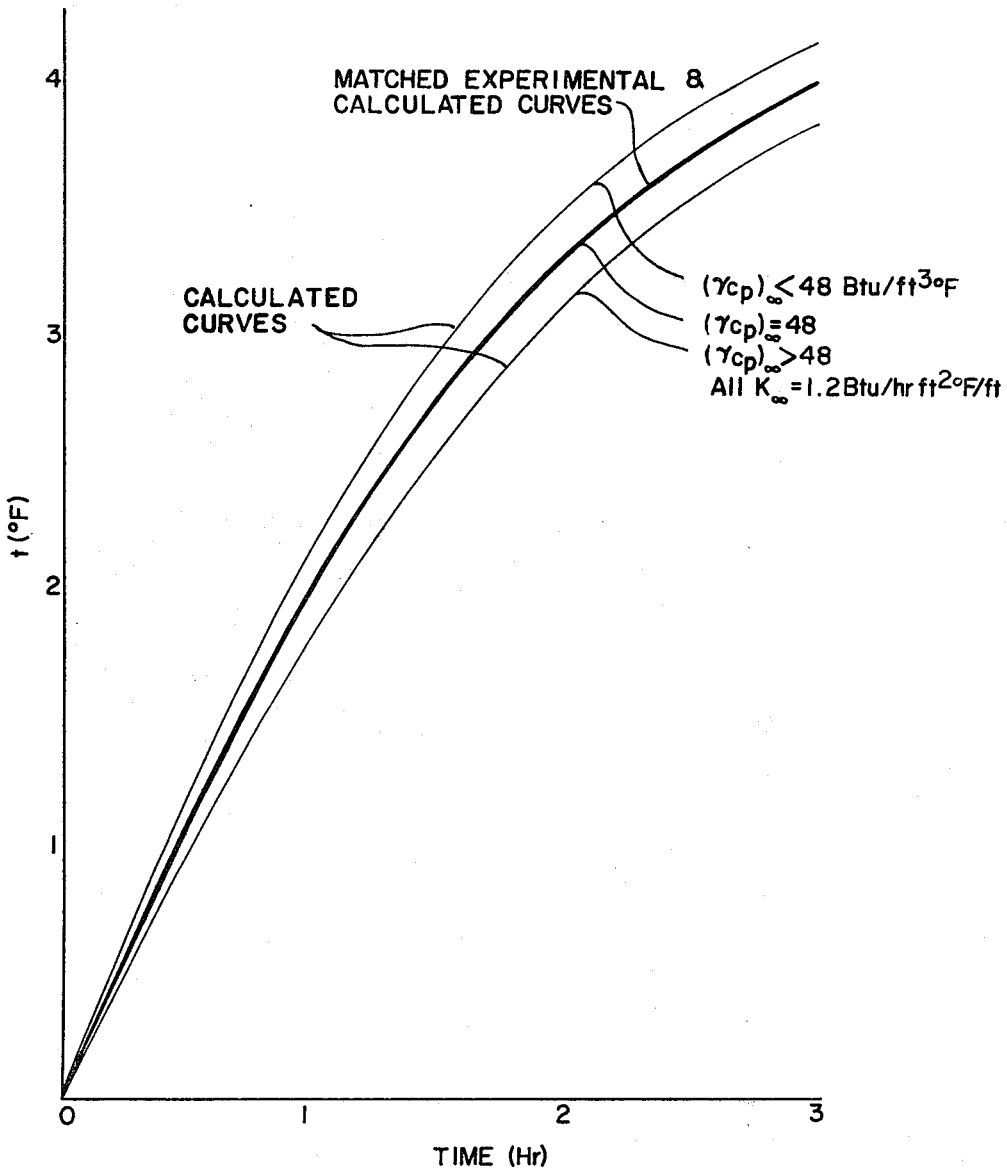
FIGS. 8 and 9 illustrate typical sets of calculated thermal gradient curves for different selected values of thermal conductivity, $k_\infty$, and thermal capacity per unit volume, $(\gamma c_p)_\infty$, of earth.
Figure 9:
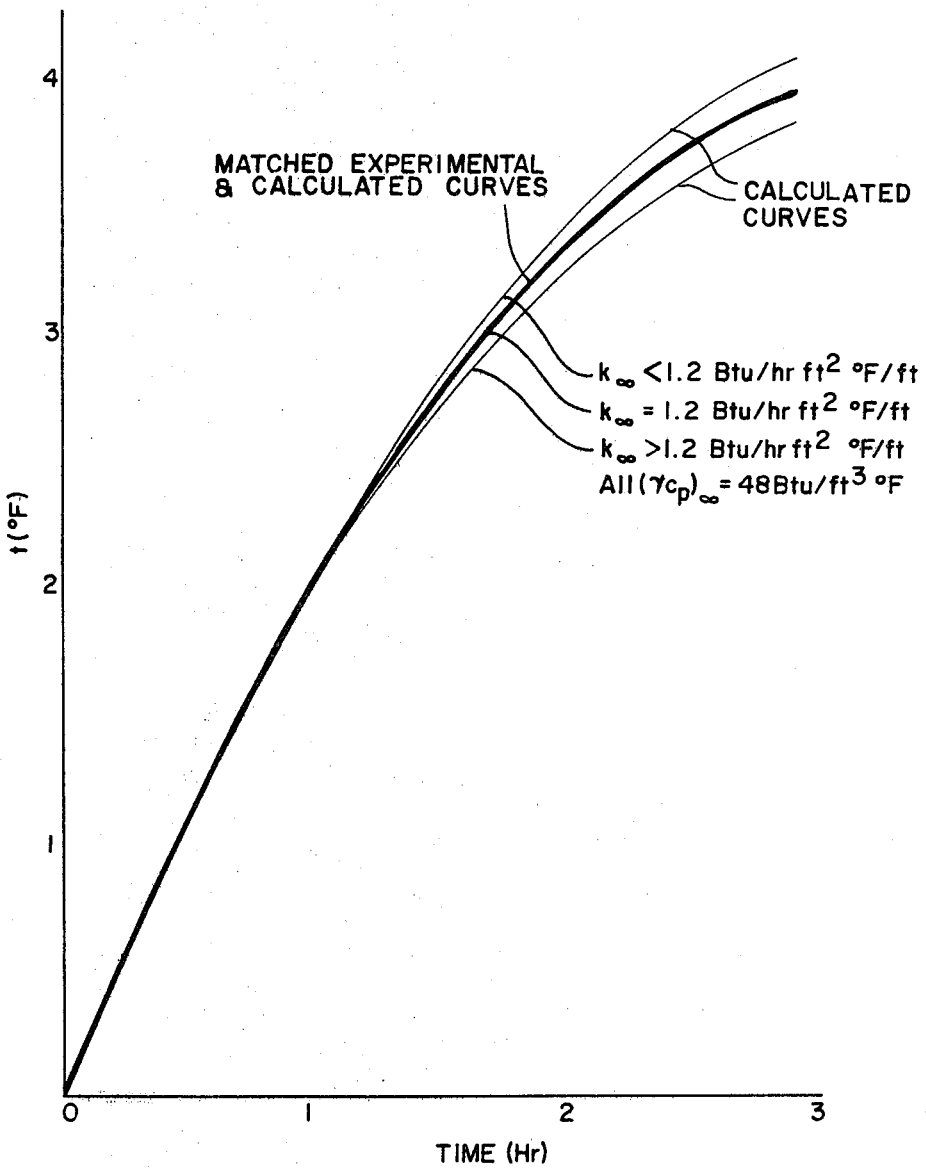

FIGS. 7, 8 and 9 illustrate this simpler numerical approach. In FIG. 7 there is shown an experimental curve for a step function of applied heat, P, equal to 65 watts, with the parameters $k_\infty$ and $(\gamma c_p)_\infty$ later determined to have the values shown. Those parameters were determined by first estimating some value of thermal capacity per unit volume, $(\gamma c_p)_\infty$, such as less than 48 Btu/ft$^3$ °F. resulting in a calculated curve having too small a slope to match the slope of the experimental curve over the initial period. The next estimate may be something less than 48 Btu/ft$^3$ °F., resulting in a calculated curve having too great a slope to match the slope of the experimental curve. The calculated curves are shown by thin lines in FIG. 8. Interpolating between the two estimates will yield a third estimate that should match the experimental curve over the initial heating period.

Using that matched value of $(\gamma c_p)_\infty$ and an estimate of thermal conductivity, $k_\infty$, that is too low, will produce a calculated curve that matches the experimetal curve over the initial period, but which departs to higher values of temperature over a longer period of heating. A second estimate that is too high will produce a calculated curve that again matches the experimental curve over the initial period of heating but then departs to lower values of temperature over a longer period. These calculated curves are again shown by thin lines in FIG. 9. Interpolating between two estimates will yield the best estimate of $k_\infty$. Now calculating and plotting a curve with these best estimates of $k_{28}$ and $(\gamma c_p)_\infty$ will result in matchd experimental and calculated curves over both the short and the long period of heating. If not, observing where and how the calculated curve departs from the experimental curve will suggest a better estimate for either or both parameters, keeping in mind that the parameter $k_\infty$ has a more pronounced effect over the long term and the parameter $(\gamma c_p)_\infty$ has a more pronounced effect over the short term. This method of determining the parameters $k_\infty$ and $(\gamma c_p)_\infty$ is significantly simplified by the fact that the thermal capacity per unit volume $(\gamma c_p)_\infty$ for most earth strata falls in a relatively narrow range of values, as reported by Koppelmeyer and Naenel, *Geothermics,* 1974, Gebrüder Borntraeger, which make the first estimates described with reference to FIG. 8 relatively easy. The estimate of thermal conductivity can then be easily adjusted to the correct "best estimate." The parameters $k_\infty$ and $(\gamma c_p)_\infty$ are thus determined with an accuracy that is within the range of accuracy in recording the rise in the temperature gradient across the probe after thermal equilibrium has first been reached and a step function of heat, P, is applied.

Although particular embodiments of the invention have been described and illustrated herein, it is recognized that modifications and variations may readily occur to those skilled in the art. Consequently, it is intended that the claims be interpreted to cover such modifications and equivalents.

What is claimed is:

1. A method of determining thermal conductivity and capacity parameters of each in situ using a probe in a borehole, said probe comprising a long cylindrical tube having means for measuring the temperature gradient along said tube, and means for surface heating one zone of said tube, comprising the steps of positioning said probe in said borehole, wherein said probe has a tube of outside diameter sufficiently less than the diameter of the borehole to facilitate lowering the probe into position, thus leaving a fluid annulus between the probe tube and the borehole wall, allowing said probe to remain in position for a period sufficient for said temperature gradient to reach thermal equilibrium, applying a known step function of heat through said surface heating means at said one end of said probe tube, recording the change in thermal gradient along said probe tube as a function of time in response to said step function of applied heat, said thermal gradient being recorded as a rise in temperature above the temperature at thermal equilibrium, and relating the recorded rise in temperature as a function of time during heating to the thermal conductivity and thermal capacity per unit volume of the surrounding earth.

2. A method as defined in clam 1 including the steps of inserting the probe in adjacent boreholes over an area of interest and repeating the procedure at each borehole, and mapping the thermal conductivity of the earth in the area.

3. A method as defined in claim 1 wherein said fluid annulus is comprised of water or mud.

4. A method for determining the thermal conductivity and capacity per unit volume parameters of the earth, comprising the steps of lowering an elongated cylindrical probe into a borehole in the earth and thermally coupling said probe to the surrounding earth, said probe being comprised of a length of tubing of thermal conductive material with a thermopile inside for measuring the thermal gradient between two zones of the cylindrical probe tubing after it has been positioned in said borehole for a period sufficient for the tubing to reach thermal equilibrium, wherein said probe is coupled to the surrounding earth by a fluid annulus, heating one of said two zones at a constant rate after said thermal equilibrium has been reached, recording as a temperature rise the temperature gradient measurements made by said thermopile while one of said two zones is being heated at a constant rate, and determining the thermal conductivity of earth surrounding said probe by relating the temperature recorded as a function of time to a calculated temperature rise as a function of time using estimates of thermal conductivity and thermal capacity per unit volume which yield a calculated temperature rise curve that best fits the curve of the recorded temperature rise.

5. A method as defined in claim 4 wherein said fluid annulus is water.

6. A method as defined in claim 4 wherein said fluid annulus is mud.

* * * * *